United States Patent [19]

Nakao

[11] 4,261,047

[45] Apr. 7, 1981

[54] DATE DRIVING MECHANISM OF WATCH

[75] Inventor: Hideyuki Nakao, Tokyo, Japan

[73] Assignee: Kabushiki Kaisha Daini Seikosha, Tokyo, Japan

[21] Appl. No.: 49,990

[22] Filed: Jun. 19, 1979

[30] Foreign Application Priority Data

Jun. 27, 1978 [JP] Japan ..... 53/77603

[51] Int. Cl.[3] ..... G04B 19/24; G04B 19/20

[52] U.S. Cl. ..... 368/38; 368/37

[58] Field of Search ..... 58/58, 4 R, 4 A, 5; 368/37, 38

[56] References Cited

U.S. PATENT DOCUMENTS

| | | | |
|---|---|---|---|
| 3,667,211 | 6/1972 | Schneider | 58/58 |
| 4,081,950 | 4/1978 | Chappatte | 58/4 R |

*Primary Examiner*—David Smith, Jr.

*Assistant Examiner*—John B. Conklin

*Attorney, Agent, or Firm*—Robert E. Burns; Emmanuel J. Lobato; Bruce L. Adams

[57] ABSTRACT

The date driving mechanism of a watch comprises a date driving wheel having a partially teethed portion engaged with teeth of a calendar driving wheel which in turn drives a calendar display dial so as to advance the calendar display dial a given amount each rotation of the date driving wheel. A cam integral with the date driving wheel engages a pivotal control member so as to hold the control member against the calendar driving wheel normally to restrain movement of the date dial. The cam has a flat side so as to release the calendar driving wheel from restraint when being driven by the teethed portion of the date driving wheel, thereby relieving load on the date driving wheel. The control member has a resilient arm which yields to permit manual correction of the calendar display.

4 Claims, 2 Drawing Figures

DATE DRIVING MECHANISM OF WATCH

BACKGROUND OF THE INVENTION

The present invention relates to a data driving mechanism of a watch. In a conventional data driving mechanism, a date dial is driven by a data finger mounted on a date driving wheel is when the date driving wheel turned around. In this case, the date dial is positioned by thrusting the date dial in a horizontal direction by a data dial control portion and the spring power of a date jumper. However, the spring power is a load which decreases the stepping torque of the watch. There is no problem if the watch is driven by a main spring as the motive power since the stepping torque of the watch is high. However, in an analogue quartz crystal watch recently developed, the stepping torque of the watch has become exceedingly small since a micro motor is used as the motive power. Accordingly the date jumper of the conventional type is a heavy load for the watch. With the advance of electronics, a long life analogue quartz crystal watch has come into practical use. However, in order to attain a long life, the current consumption should be made small and thereby it is necessary to decrease the date driving resistance since the power of micro motor becomes small. By way of a mechanism to decrease the date driving resistance, a date driving mechanism using an intermittent gear device (Geneva gear) has been proposed. In this case, however, it is disadvantageous that the date correcting mechanism cannot be easily realized and thereby a complicated intermittent gear mechanism using a clutch wheel has been used.

It is an object of the present invention to provide a data driving mechanism which decreases the load in case of date driving using a wheel which engages a date dial, a member which restrains rotation of the date driving wheel and a cam which controls the restraining member.

DESCRIPTION OF PREFERRED EMBODIMENT

Figure 1:
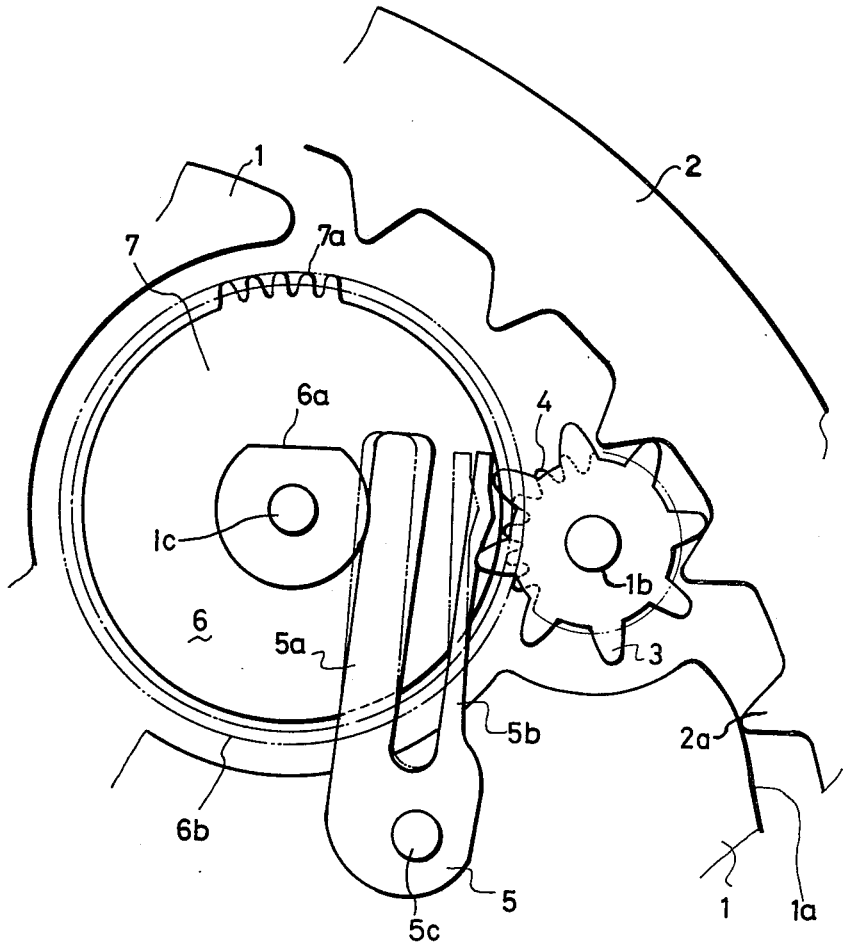
FIG. 1 is a plan view of date driving mechanism of a watch in accordance with the present invention, showing the state in which the date dial is being restrained by a control member.
Figure 2:
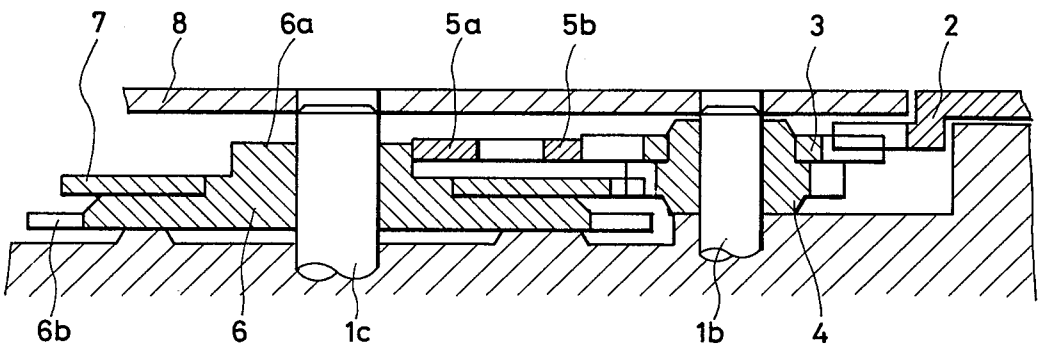
FIG. 2 is a sectional view showing a date driving wheel, a cam, a control member, gears and a date dial of FIG. 1.

Referring now to a preferred embodiment of the present invention. FIG. 1 shows a construction of the date driving mechanism, wherein numeral 1 is a base plate having a wall 1*a* which serves as a rotation guide of a date dial 2 having internal teeth 2*a*. The date dial 2 is positioned in a normal position by a gear 4 which serves as a date dial driving member. The gear 4 is positioned by a control member 5 which is pivoted at 5*c* and engages a cam 6*a* provided on a date driving wheel 6 which turns round a pin 1*c* set in the base plate 1 and is energized by a watch movement gear train element. The control member 5 cannot rotate except in case the date wheel is driven. The gear 4 is integral with a gear 3 having a different number of teeth and is engaged by teeth 7*a* of a partially teethed gear 7 which is integral with the date driving wheel 6. The gears 3 and 4 turn round a centering pin 1*b* driven into the base plate 1. Referring then to FIG. 2 which shows the sectional construction of the present invention. The teeth 2*a* of the date dial 2 are engaged by the gear 3 integral with the gear 3. An elastic portion 5*b* of the control lever 5 engages to the gear 3 and a rigid portion 5*b* thereof engages to the cam 6*a*. The partially teethed gear 7 is driven with the date driving wheel 6 and turns around a pin 1c set in the base plate 1. Numeral 8 designates a date dial guard not shown in FIG. 1 which determines a gap in the thrust direction of gears 3, 4 and the partially teethed gear 7.

Referring to the operation of the present invention. Since the curvature of the cam 6*a* is constant except for a flat portion where the date is to be driven, the data dial 2 is positioned by engagement of the elastic portion 5*b* of the control member 5 and the gear 3. When the dial 2 is driven by the rotation of the date driving wheel 6, a straight lined portion of the cam 6*a* gradually comes into contact with portion 5*a* of the control member 5, and the rotation of the control member 5 in 9 a direction becomes possible since a clearance is created. At the same time the gear 4 begins to turn round by reason of engagement with the teeth 7*a* of the partially teethed gear 7 and the cam 6*a* gradually turns round. Then the control member 5 reaches the position shown by the two dotted line in FIG. 1 and does not restrain the gear 3 integral with the gear 4. When the control member 5 reaches the original position again by the rotation of the cam 6*a*, the gear 4 has been turned through 90 degrees by the teethed portion 7*a* of the partially teethed gear 7, and thereby the date dial 2 has been advanced and is again positioned by the control member 5 and the cam 6*a* after the date dial 2 has been advanced to a date. When the new date dial 2 is forcibly turned round by a date dial correcting device not shown, the gear 4 turns round energized by the date dial 2, and the elastic portion 5*b* of the control member 5 is bent and thereby the date correction becomes possible.

As illustrated so far, according to the present invention, resistance in case the date dial is driven can be decreased, a stepping torque larger than the elastic power of a data jumper spring becomes unnecessary, power consumption can be decreased and thereby the life expectancy of an analogue quartz watch becomes greater. As for the type employing an intermittent gear device, the date driving mechanism becomes complexed by the provision of the date correcting device. While according to the present invention, a member which restrains gears is made as an elastic member, and thereby the date dial is easily driven by flexure of the elastic portion when the date dial is driven by a date correcting device.

I claim:

1. Date driving mechanism of a watch comprising:

a date driving wheel comprising a gear portion having teeth on its entire periphery and driven by a gear train of said watch and a partially teethed portion having a selected number of teeth on its periphery.

a calendar driving wheel having teeth engaged by said teeth of said partially teethed portion to turn said calendar driving wheel a selected amount in each rotation of said date driving wheel, a rotary calendar display member driven by said calendar driving wheel, restraining means engageable with said calendar driving wheel, normally to restrain rotation of said calendar driving wheel and movement of said calendar display member, and cam means rotating with said date driving wheel and cooperating with said restraining means to release said restraining means during the time said teeth of said partially teethed portion of said date driving wheel engage teeth of said calendar driving wheel to ease the movement of said calendar display member while being driven by said calendar driving wheel and thereby relieve load on said date driving wheel.

2. Date driving mechanism according to claim 1, in which said cam means comprises a cam integral with said date driving wheel.

3. Date driving mechanism according to claim 1, in which said remaining means comprises a pivotal control member having an elastic portion engageable with said calendar driving wheel and yieldable to permit movement of said calendar display member for date correction.

4. Date driving mechanism according to claim 1, in which said calendar display member is annular and has integral teeth, and in which said calendar driving wheel has teeth engageable by teeth of said partially teethed portion of said date driving wheel and other teeth engageable with teeth of said calendar display member and with said restraining means.

* * * * *